US011745176B2

(12) United States Patent
Ganter

(10) Patent No.: US 11,745,176 B2
(45) Date of Patent: Sep. 5, 2023

(54) LEAK RESISTANT DROPPERS

(71) Applicant: Bottle Barons, LLC, Plano, TX (US)

(72) Inventor: Benjamin Alan Ganter, Plano, TX (US)

(73) Assignee: Bottle Barons, Plano, TX (US)

( * ) Notice: Subject to any disclaimer, the term of this patent is extended or adjusted under 35 U.S.C. 154(b) by 0 days.

(21) Appl. No.: 17/352,848

(22) Filed: Jun. 21, 2021

(65) Prior Publication Data

US 2021/0379577 A1 Dec. 9, 2021

Related U.S. Application Data

(63) Continuation of application No. 16/581,722, filed on Sep. 24, 2019, now Pat. No. 11,040,342, which is a continuation of application No. 29/664,291, filed on Sep. 24, 2018, now Pat. No. Des. 905,850.

(60) Provisional application No. 62/735,500, filed on Sep. 24, 2018.

(51) Int. Cl.
*B01L 3/02* (2006.01)
*B65D 47/18* (2006.01)

(52) U.S. Cl.
CPC ..... *B01L 3/0282* (2013.01); *B01L 3/021* (2013.01); *B01L 3/0241* (2013.01); *B01L 3/0272* (2013.01); *B65D 47/18* (2013.01); *B01L 2200/0615* (2013.01); *B01L 2200/087* (2013.01); *B01L 2400/0406* (2013.01)

(58) Field of Classification Search
CPC ..... B01L 3/0282; B01L 3/021; B01L 2400/0481; B01L 2300/123; B01L 2300/047; B01L 3/0272; B01L 3/241; B01L 2200/0615; B01L 2200/087; B01L 2400/0406; A45D 2200/10; A45D 34/04; A45D 34/00; B65D 47/00; B65D 47/18
See application file for complete search history.

(56) References Cited

U.S. PATENT DOCUMENTS 2,742,195 A * 4/1956 Elder, Jr. ..... B01L 3/0282 422/934
3,158,183 A * 11/1964 Brown ..... B01L 3/0282 222/207
4,768,682 A * 9/1988 Friedrich ..... B65D 41/06 422/934
5,154,702 A * 10/1992 Foyil ..... B01L 3/0282 215/214
2017/0079407 A1* 3/2017 Chen ..... A45D 34/04

FOREIGN PATENT DOCUMENTS

GB 324585 A * 1/1930

* cited by examiner

*Primary Examiner* — Jason K Niesz
(74) *Attorney, Agent, or Firm* — Ferguson Braswell Fraser Kubasta PC

(57) ABSTRACT

In various implementations, a dropper for a bottle may include a bulb with a flange and an extended leg. The dropper may be used as a cap, in some implementations, with or without a skirt. The dropper may inhibit leaks from a bottle when the dropper is used as a cap for the bottle.

20 Claims, 11 Drawing Sheets

LEAK RESISTANT DROPPERS

CROSS-REFERENCE TO RELATED APPLICATIONS

This application is a continuation of U.S. patent application Ser. No. 16/581,722 entitled "LEAK RESISTANT DROPPERS" and filed on Sep. 24, 2019, which claims the benefit of priority to U.S. Patent Application No. 62/735,500 entitled "LEAK RESISTANT DROPPERS" and filed Sep. 24, 2018 and is a continuation of U.S. Design patent application Ser. No. 29/664,291, entitled "DROPPER CAPABLE OF BEING USED AS BOTTLE CAP" and filed Sep. 24, 2018, all of which are hereby incorporated by reference for all purposes.

TECHNICAL FIELD

The present invention relates to droppers and bottles that utilize droppers.

BACKGROUND

Droppers (e.g., bulb pipettes) are commonly used to dispense medicine, wellness products (e.g., essential oils, vitamins, and/or supplements), cosmetics (e.g., foundations, serums, etc.), and other fluids. The droppers are often used with a skirt to form a cap for a bottle of fluids. However, even droppers that appear to fasten securely often leak. While the dropper cap may not appear to leak since the cap may be tightly fastened, the caps may leak when the bottles are shipped (e.g., due to vibration and/or changes in temperature and/or pressure). Additionally bottles may leak when fail to fully tighten the cap or over tighten the cap, which may cause damage to the cap and/or bulb.

SUMMARY

In various implementations, a dropper may be provided that is capable of being used with bottle(s). The dropper may be utilized as a cap, with or without a secondary cap (e.g., a skirt) coupled to the dropper.

The dropper may include a pipette, and a bulb coupled to a first end of the pipette. The bulb may include a flange and/or a collar. The flange may be capable of resting on the top of a bottle to at least partially inhibit leaks from the bottle. The collar may be disposable at least partially in the bottle to inhibit leaks from the bottle.

In various implementations, a bottle may include a dropper and a bottle. The dropper may be disposed at least partially in the bottle to close it and removed to open it. The bulb of the dropper may be utilized to dose fluids from the bottle for various applications. The dropper may include a bulb with a closed end and an opposing open end. The pipette of the dropper may be disposed at least partially in the open end of the bulb. The bulb may include at least one cavity extending between the closed and the open end of the bulb. The cavity may include a pipette coupling member (e.g., recess, ledge between cavities and/or portions of cavities, etc.) configured to receive at least a portion of a pipette. The pipette coupling member may retain at least a portion of the pipette in the cavity of the bulb. The bulb may include a flange and a collar. The flange of the bulb may extend from an outer surface of the body of the bulb between the open end and the closed end of the body. The flange of the bulb may include a first surface (e.g., proximate the closed end of the bulb) and an opposing second surface (proximate the open end of the bulb). The flange of the bulb may have a greater diameter than an opening of a bottle in which the dropper is positionable. The collar of the bulb may be disposed proximate the open end of the bulb. The collar may include an inner surface proximate the cavity of the bulb and an outer surface. The pipette of the dropper may extend into the cavity of the bulb (e.g., extend into and be proximate the inner surface of the collar, extend past the collar, etc.). The pipette may include a top portion, which is received in the pipette receiving member of the cavity of the bulb, and an elongated body. The elongated body may include a lumen (e.g., disposed through the elongated body of the pipette). During use, fluid from a bottle may be drawn into the lumen of the pipette (e.g., by releasing a depressed dropper bulb) and expelled from the lumen of the pipette (e.g., by depressing the dropper bulb). A gap may reside between at least a portion of the collar of the bulb and at least an outer wall of the pipette disposed in the collar. The bottle may include a neck with a bottle opening disposed through the neck into the bottle cavity. The neck may have a top surface proximate the bottle opening. The second surface of the flange of the bulb may be configured to contact the top surface of the neck of the bottle when the dropper closes the bottle. The collar of the dropper may be positioned in the bottle when the dropper closes the bottle. The inner walls of the neck may contact at least a portion of an outer surface of the collar of the bulb, when the dropper is disposed in the bottle to retain the dropper in the bottle and inhibit leaks from the bottle. By closing the bottle with the dropper leaks may satisfy transportation leaking resistant requirements.

Implementations may include one or more of the following features. The bulb may include a rounded shape portion proximate a closed end. The collar may include a tapered portion, and the tapered portion may ease insertion of the dropper into the bottle. The outer surface of the collar of the bulb may include at least one recess, which is configured to create a void between side walls of the neck of the bottle and the outer surface of the collar. The void may decrease leakage of fluids in the bottle. The pipette coupling member may include at least one recess disposed in the cavity of the bulb. The recess(es) of the pipette coupling member may be disposed above the flange. The pipette may include a lip extending from the body of the pipette proximate the top portion. The lip of the pipette may be retained and/or received by recess(es) in the cavity of the bulb. The cavity may include a narrow portion proximate the top portion of the pipette. The narrow portion of the cavity may approximately align with the lumen of the pipette such that fluid in the bulb of the dropper is transmitted to the lumen of the pipette when the dropper is depressed. The outer surface of the bulb may include a recess disposed between the closed end of the bulb and the flange. In some implementations, the dropper may include a cap with a skirt and side walls. The skirt may include an aperture through which the bulb may be disposed. The skirt may be received by the recess of the bulb. The side walls may extend from the skirt (e.g., radially about the skirt). The side walls may be disposed proximate outer side walls of the neck of the bottle when the dropper is disposed in the bottle. The bottle may include threads on an outer surface of the neck. The inner surface of the side walls of the cap may include threads that are capable of mating with the threads on the outer surface of the neck. Mating the threads of the cap and the neck may inhibit leaks.

In various implementations, a dropper may include a bulb, with a closed end and an opposing open end, and a pipette partially disposed in the bulb. The pipette of the dropper may be disposed at least partially in the open end of the bulb. The bulb may include at least one cavity extending between the closed and the open end of the bulb. The cavity may include a pipette coupling member (e.g., recess, ledge between cavities and/or portions of cavities, etc.) configured to receive at least a portion of a pipette. The pipette coupling member may retain at least a portion of the pipette in the cavity of the bulb. The bulb may include a flange and a collar. The flange of the bulb may extend from an outer surface of the body of the bulb between the open end and the closed end of the body. The flange of the bulb may include a first surface (e.g., proximate the closed end of the bulb) and an opposing second surface (proximate the open end of the bulb). The flange of the bulb may have a greater diameter than an opening of a bottle in which the dropper is positionable. The collar of the bulb may be disposed proximate the open end of the bulb. The collar may include an inner surface proximate the cavity of the bulb and an outer surface. The pipette of the dropper may extend into the cavity of the bulb (e.g., extend into and be proximate the inner surface of the collar, extend past the collar, etc.). The pipette of the dropper may extend into the cavity of the bulb (e.g., extend into and be proximate the inner surface of the collar, extend past the collar, etc.). The pipette may include a top portion, which is received in the pipette receiving member of the cavity of the bulb, and an elongated body. The elongated body may include a lumen (e.g., disposed through the elongated body of the pipette). A gap may reside between at least a portion of the inner surface of the collar of the bulb and at least a portion of an outer wall of the pipette disposed in the collar such that at least a portion of the pipette disposed in the collar may be capable of radially movement.

Implementations may include one or more of the following features. The pipette may include a lip extending from the body of the pipette proximate the top portion. The lip may be received by a recess in the cavity of the bulb. The outer surface of the bulb may include a recess disposed between the closed end of the bulb and the flange. The dropper may include a cap (e.g., disposed about the bulb). The cap may include a skirt and side wall(s) extending from the skirt. The skirt may include an aperture through which the bulb may be disposed. The skirt may be received by the recess of the bulb. The flared portion of the bulb may extend over the skirt and/or may have a diameter greater than the aperture of the skirt. The side walls of the cap may extend from the skirt. The side walls may be disposed proximate outer side walls of the neck of the bottle when the dropper is disposed in the bottle. The side walls of the cap may include threads configured to mate with threads on an exterior of a bottle. The collar may be at least partially compressed when the collar of the dropper is inserted into a bottle to close the bottle such that leaks are inhibited.

In various implementations, a dropper may include a bulb, with a closed end and an opposing open end, and a pipette partially disposed in the bulb. The pipette of the dropper may be disposed at least partially in the open end of the bulb. The bulb may include at least one cavity extending between the closed and the open end of the bulb. The cavity may include a pipette coupling member (e.g., recess, ledge between cavities and/or portions of cavities, etc.) configured to receive at least a portion of a pipette. The pipette coupling member may retain at least a portion of the pipette in the cavity of the bulb. The bulb may include a flange and a collar. The flange of the bulb may extend from an outer surface of the body of the bulb between the open end and the closed end of the body. The flange of the bulb may include a first surface (e.g., proximate the closed end of the bulb) and an opposing second surface (proximate the open end of the bulb). The flange of the bulb may have a greater diameter than an opening of a bottle in which the dropper is positionable. The collar of the bulb may be disposed proximate the open end of the bulb. The collar may include an opening that provides access to the cavity of the bulb. The opening in the collar may be greater than the diameter of the pipette to be received by the cavity such that a gap is created between the outer wall of the pipette and an inner wall of the pipette.

Implementations may include one or more of the following features. A pipette may be partially disposed in a cavity of the bulb. The pipette may include a lip extending from the body of the pipette proximate the top portion. The lip may be received by a recess in the cavity of the bulb.

The outer surface of the bulb may include a recess disposed between the closed end of the bulb and the flange. The dropper may include a cap, which includes a skirt and side walls extending from the skirt. The skirt may include an aperture through which the bulb may be disposed. The skirt may be received by the recess of the bulb and may be disposed on a surface of the flange. The flared portion of the bulb may extend over the skirt and may have a diameter greater than the aperture of the skirt. The side walls be disposed proximate outer side walls of the neck of a bottle when the dropper is disposed in the bottle. The cavity of the bulb may include a narrow portion proximate the top portion of the pipette, and wherein the narrow portion of the cavity approximately aligns with the lumen of the pipette such that fluid in the bulb of the dropper is transmitted to the lumen of the pipette when the dropper is depressed. The flange of the bulb may have a greater diameter than the flared portion of the bulb.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Droppers (e.g., bulb pipettes, Pasteur pipettes, etc.) are commonly used to transfer fluids from one container. Dropper may be used with a variety of fluids and can be used to provide, for example, metered amounts for a particular application. For example, droppers may be used to transfer fluids such as medicine(s) and/or nutritional supplement(s) from a bottle to a user (e.g., a mouth) to administer a dosage of the medicine(s) and/or nutritional supplement(s). As another example, droppers may be used to transfer fluids such as serums and/or essential oils to a user's hands for application on the user. Droppers may also be used to transfer small quantities of ingredients such as flavorings and/or colorings to a mixture (e.g., food, pharmaceutical, cosmetic, wellness, and/or nutritional products).

A dropper may include a pipette and a bulb coupled to an end of the pipette. At least a portion of the bulb may be flexible (e.g., made from one or more flexible materials). For example, a user may be capable of depressing the bulb (e.g., exerting a force on at least one side of the bulb) and/or squeezing the bulb (e.g., exerting forces on at least two sides the bulb). At least a portion of the bulb may be elastically deformable. Thus, the bulb may return to substantially the same shape and/or orientation after a user releases the bulb (e.g., stops squeezing the bulb). The pipette may have a lumen extending through the body of the pipette, which may allow fluids to be drawn into the pipette (e.g., lumen of the pipette).

A dropper may be capable of drawing fluids into the pipette and/or releasing fluids disposed in the pipette. For example, a user may squeeze and/or depress a bulb of a dropper, which may push air out of the lumen of a pipette and may cause a partial vacuum (e.g., an area within the bulb with a lower pressure than atmospheric) in the dropper or portion thereof. An end of the pipette may be disposed proximate fluid(s). In some implementations, a pipette may be preloaded with a fluid. As the user releases the bulb, fluids may be drawn at least partially into a lumen of the pipette. The user may then squeeze and/or depress the bulb to release at least a portion of the fluid in the pipette.

Figure 1A:
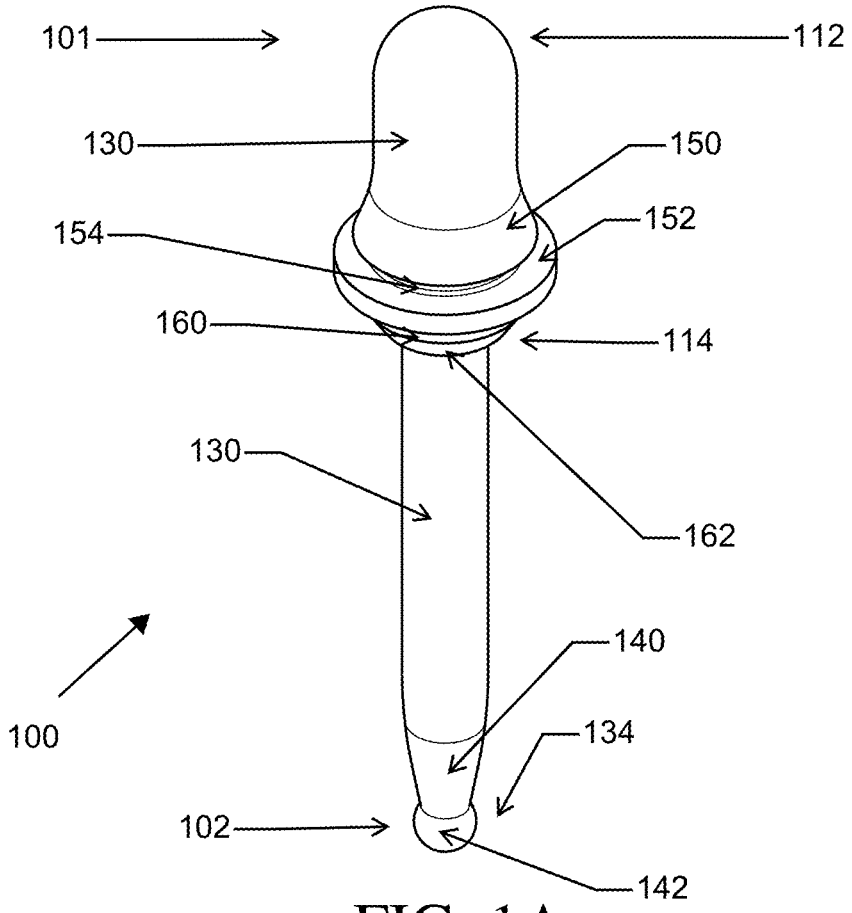
FIG. 1A illustrates top perspective view of an implementation of an example dropper.
Figure 1B:
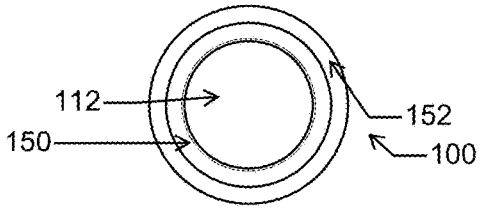
FIG. 1B illustrates a top view of an implementation of the example dropper illustrated in FIG. 1A.
Figure 1C:
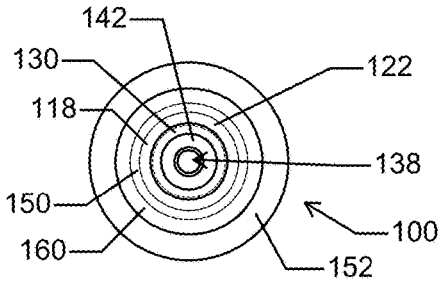
FIG. 1C illustrates a bottom view of an implementation of the example dropper illustrated in FIG. 1A.
Figure 1D:
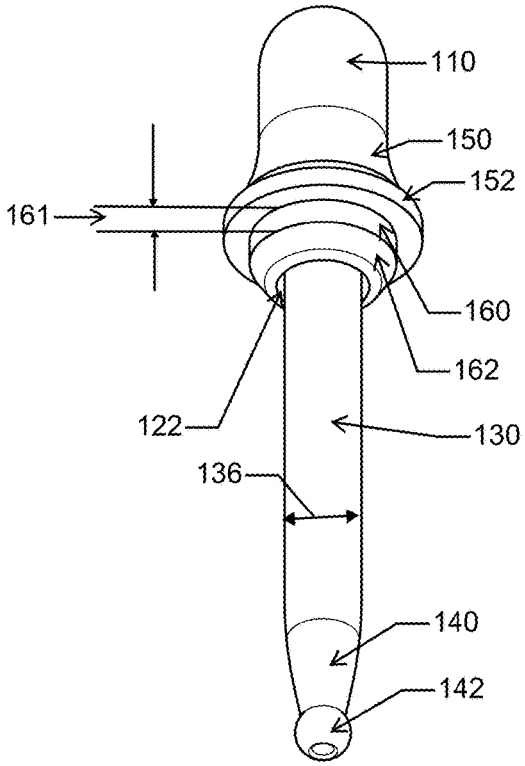
FIG. 1D illustrates a bottom perspective view of an implementation of the example dropper illustrated in FIG. 1A.
Figure 1E:
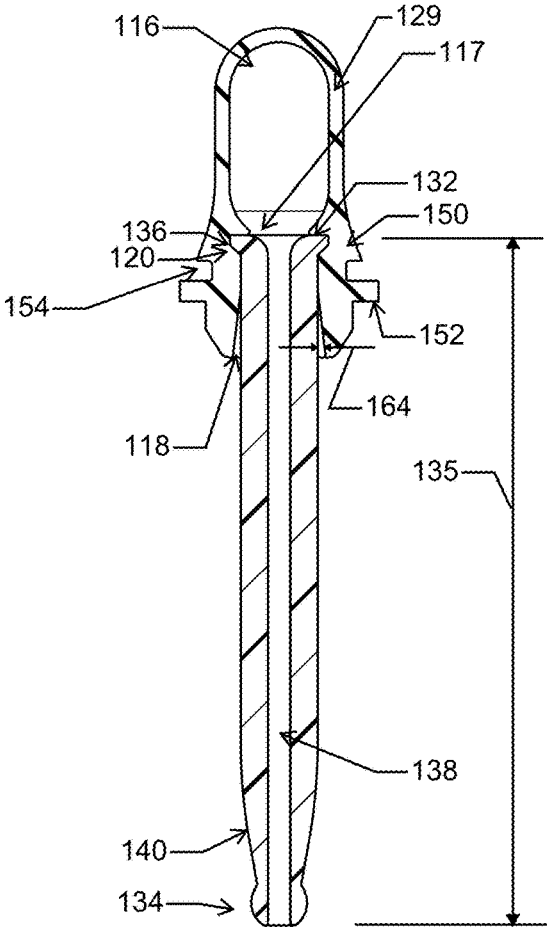
FIG. 1E illustrates a cross-sectional view of an implementation of the example dropper illustrated in FIG. 1A.

FIGS. 1A-1E illustrate an implementation of a dropper 100 from various perspectives. FIG. 1A illustrates a top perspective view of the dropper 100. FIG. 1B illustrates a top view of the dropper 100 and FIG. 1C illustrates a bottom view of the dropper 100. FIG. 1D illustrates a bottom perspective view of the dropper 100. FIG. 1E illustrates a cross-sectional view of dropper 100. The dropper 100 may include a first end 101 and a second opposing end 102. The dropper 100 may include bulb 110 and a pipette 130 coupled to the bulb.

As illustrated the bulb 110 may include a first end 112 and an opposing second end 114. The bulb may have a first cavity 116 and a second cavity 118. The first cavity 116 and the second cavity 118 may be continuous. In some implementations, the first cavity 116 may narrow proximate an end of the pipette (e.g., the end disposed in the bulb). For example, a portion 117 of the first cavity 116 may have a similar dimension (e.g., diameter, width, and/or length) to the dimension of an opening in the pipette proximate the portion of first cavity. The first cavity may be in communication (e.g., fluid communication) with the lumen of the pipette. Thus, when the bulb 110 is depressed and/or squeezed at least a portion of the air in the bulb is pushed out of the bulb, through the lumen of the pipette, and out of the pipette to create a partial vacuum in the dropper (e.g., lumen of the pipette and/or first cavity of the bulb). Air driven out of the first cavity may be inhibited (e.g., by the body of the pipette) from being released via the second cavity 118 of the bulb when a pipette 130 is coupled to the bulb. In some implementations, when fluid is drawn into the pipette it may be drawn into the first cavity 116 of the bulb 110 (e.g., due to overfill of the pipette, altering the orientation of the pipette such as moving the dropper sideways and/or upside down). Fluid (e.g., inadvertently) in the first cavity 116 of the bulb 110 may be inhibited from leaking out of the bulb via the second cavity 118 (e.g., the body of the pipette may block fluid communication between the first cavity and the second cavity of the bulb).

The second cavity 118 of the bulb 110 may be disposed farther from the first end 116 of the bulb than the first cavity 116. An opening 122 may reside where the second cavity 118 extends through the bulb. The second cavity 118 may receive at least a portion of the pipette 130.

As illustrated, the pipette 130 may include a first end 132 and a second end 134. The pipette may have a length 135 between the first end 132 and the second end 134. At least a portion of the pipette may be cylindrical and/or may have a diameter 136. The pipette 130 may have a lumen 138 extending from the first end 132 to the second end 134 of the pipette. Thus, the pipette may have a first opening in the first end and a second opening at the second end (e.g., the lumen may terminate at the first opening and the second opening of the pipette). The pipette 130 may have a tapered portion 140 proximate the second end 134. The tip (e.g., an area proximate the second end 134 of the pipette 130) may be linear (e.g., in line with the body of the pipette) or bent. The pipette may have a rounded end 142, as illustrated, and/or a tapered end.

At least a portion of the first end 132 of the pipette may be received in the second cavity 118 of the bulb 110. The first end 132 of the pipette 132 may be inhibited from entering the first cavity 116 of the bulb 110 due to the narrower portion 117 of the bulb. By inhibiting the first end of the pipette 132 from entering and/or substantially entering the first cavity 116 of the bulb (e.g., such that the first end of the pipette contacts an inner wall of the first end of the bulb), damage to the pipette may be inhibited (e.g., a user may not crush a pipette when squeezing the bulb), and/or operation may be maintained (e.g., squeezing the bulb may not produce a partial vacuum if the first cavity is occupied and/or partially occupied by a pipette).

A pipette flange 136 may be disposed proximate the first end 132 of the pipette 130. The pipette flange 136 may extend radially from a body of the pipette 110 proximate the first end 132 of the pipette. The pipette flange 136 may facilitate retention of the pipette 130 in the bulb 110. As illustrated, the bulb 110 may include a recess 120 which may receive at least a portion of the pipette flange 136. The recess 120 may be disposed in the bulb 110 between the first cavity 116 and the second cavity 118 of the bulb. The recess 120 may at least partially inhibit movement of the pipette out of the opening 122 of the bulb and/or into the first cavity 116 of the bulb 110.

As illustrated, the first cavity 116 of the bulb 110 may narrow at portion 117. This portion 117 may inhibit the first end 132 of the pipette 130 from entering and/or substantially entering the first cavity 116 of the bulb 110.

The exterior of the first end 116 of the bulb 110 may have any appropriate shape. As illustrated, at least a portion of the bulb 110 may be bell shaped. The first end 116 of the bulb 110 may include a flared portion 150 that may flare outward (e.g., away from a cavity of the bulb). In some implementations, a bell shaped (e.g., domed first end that flares as it extends away from the first end) may be selected as the bulb shape to increase suction power of the bulb (e.g., as opposed to a flat top bulb of similar size that may be restricted from being fully depressed by the shape).

The bulb 110 may include a flange 152. The flange 152 may be disposed between the first end 112 and the second end 114 of the bulb 110. The flange 152 may be disposed farther away from the first end 116 of the bulb than the flared portion 150 of the bulb 110. The flange 152 may extend outwards (e.g., away from a cavity of the bulb) from the body of the bulb 110. The flange 152 may be a protrusion extending from the bulb 110. The flange may be a ring shaped, in some implementations. The flange 152 may be configured such that the flange rests on a top surface of a bottle opening (e.g., a lip of a bottle opening), when disposed in a bottle. FIG. 2A-2E illustrate an implementation of an example bottle assembly 200 from various views. As illustrated in FIGS. 2A-2E, the dropper 100 may be disposed at least partially in the bottle 210 (e.g., to close the bottle). Disposing the dropper in the bottle may close the bottle and/or may allow fluids to be drawn from the bottle. The bottle 210 may have an outer surface 212 and an inner surface 212. The bottle may have a cavity in which fluids may be stored. The fluids may be accessible via an opening in the neck 220 of the bottle 210. The neck 220 may have threads 222 that may engage threads in a cap, in some implementations. The neck 220 of the bottle 210 may have a lip 224 proximate the opening of the bottle. The flange 152 of the dropper 100 may be disposed proximate the lip 224 of the neck 220 of the bottle 210 when the dropper is inserted in the bottle to draw fluids in the lumen 138 of the pipette 130 and/or to close the bottle with the dropper.

The dropper 100 may include a collar 160, as illustrated in FIGS. 1A-1E and 2E. The collar may be flexible (e.g., formed of a flexible material) and/or compressible. The collar 160 may be disposed proximate the second end 114 of the dropper 100. The collar 160 may at least partially surround the second cavity 116 of the dropper 100 and/or at least partially surround at least a portion of the pipette 130 received by the bulb 110. The collar may maintain and/or retain an alignment of the pipette with respect to the dropper. For example, in conventional droppers, the pipette may be capable of contacting a side of a bottle since the bulb does not secure position of the pipette but allows radial movement about the bulb. The length of the collar may inhibit the pipette movement greater than a predetermined amount (e.g., the pipette may contact the collar and movement may be inhibited). Thus, breakage of the pipette and/or noise (e.g., due to contact between the pipette and the bottle) may be inhibited.

Figure 1F:
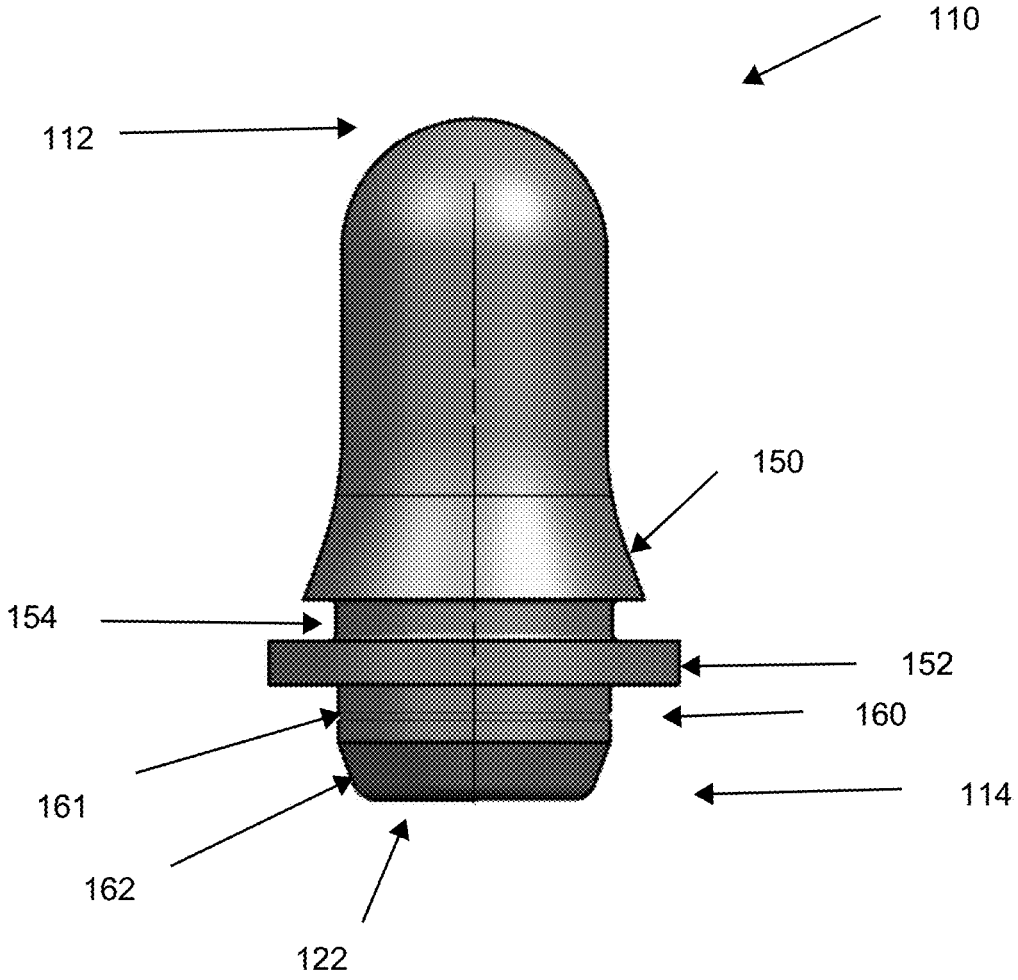
FIG. 1F illustrates an implementation of an example dropper.
Figure 2A:
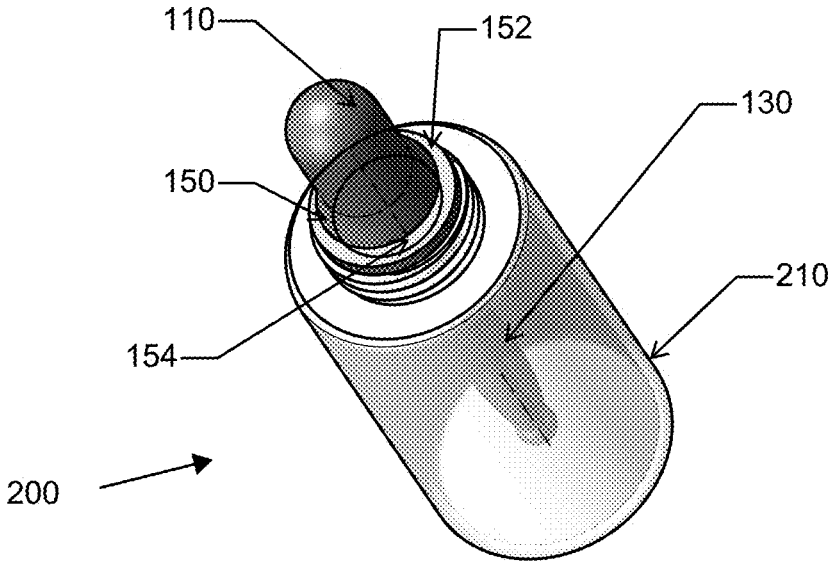
FIG. 2A illustrates a top perspective view of an implementation of an example dropper in an example bottle.
Figure 2B:
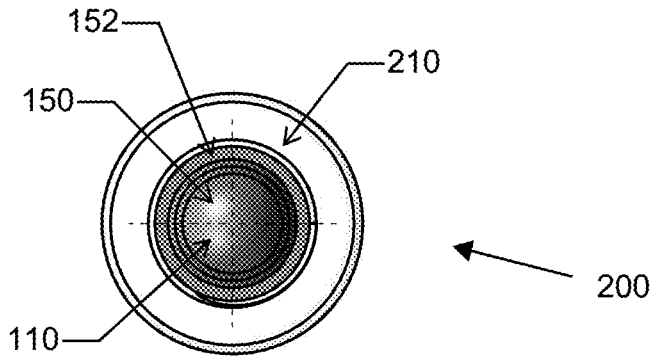
FIG. 2B illustrates a top view of an implementation of the example dropper in the example bottle illustrated in FIG. 2A.
Figure 2C:
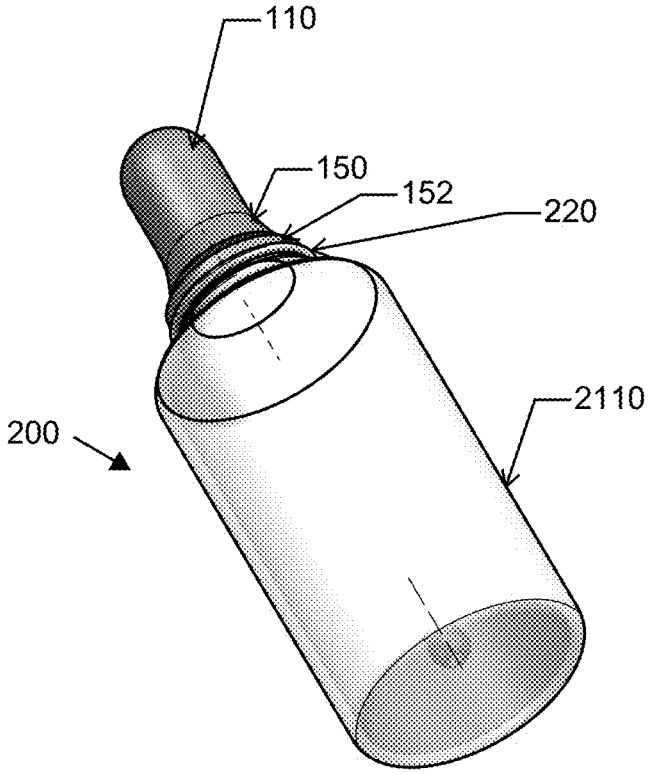
FIG. 2C illustrates a bottom perspective view of an implementation of the example dropper in the example bottle illustrated in FIG. 2A.
Figure 2D:
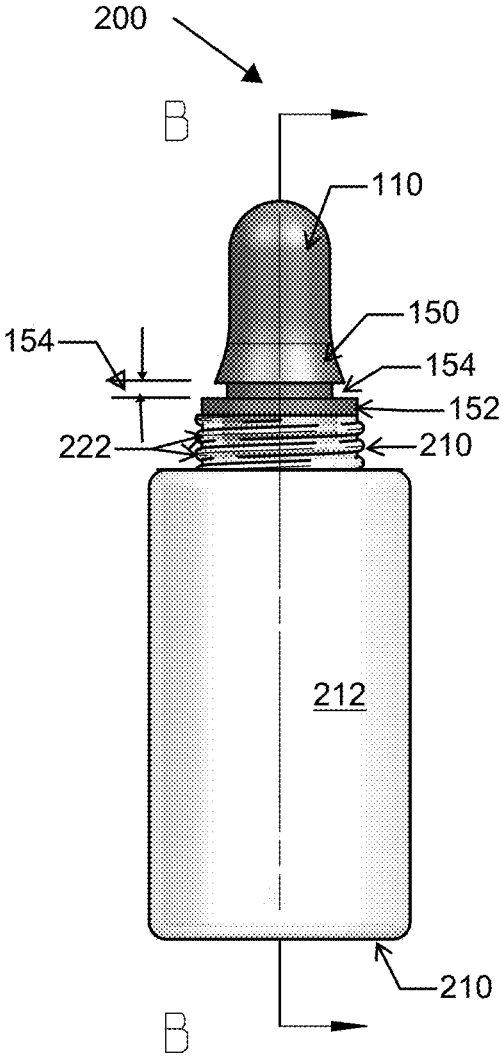
FIG. 2D illustrates a side view of an implementation of the example dropper in the example bottle illustrated in FIG. 2A.
Figure 2E:
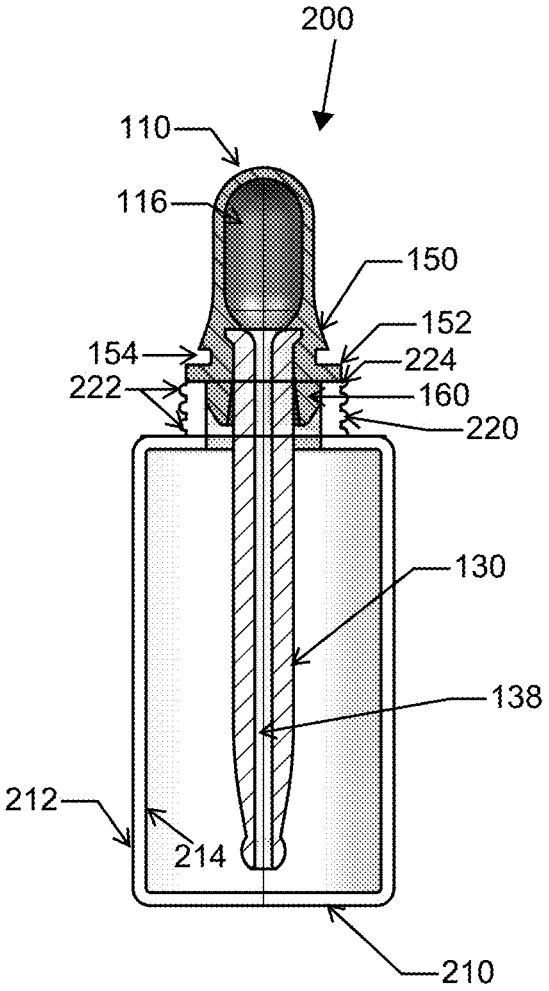
FIG. 2E illustrates a cross-sectional view of an implementation of the example dropper in the example bottle illustrated in FIG. 2A.

In some implementations, the collar 160 of the dropper may have side walls may extend from the flange and have a straight portion and a tapered portion 162. The straight portion may be closer to the flange of the bulb than the tapered portion 162 and may have opposing side walls are approximately parallel to each other. The straight portion may include one or more recesses 161 as illustrated in FIG. 1F. As illustrated, a recess 161 may extend around an exterior perimeter of the collar 160. The recess 161 may create increase the gripping properties of the dropper (e.g., in relation to inner walls of the neck of a bottle in which the dropper is disposed). The recess 161 of the collar may generate a void between the collar and an inner surface of the bottle proximate the recess when the dropper is disposed in the bottle. The void may allow excess liquid, if any, to accumulate in the void rather than residing between the straight sections of the collar and the inner surface of the bottle. For example, as the dropper is inserted in the neck of the bottle, excess liquid may be pushed by the force of the insertion of the dropper and accumulate in the void. By allowing excess liquid proximate the neck of the bottle to accumulate in the void, the retention of the dropper in the bottle may be increased and leaks may be decreased.

A gap 164 may reside between the inner surface of the collar 162 (e.g., at least a portion of the second cavity 118) and an outer surface of the pipette when the dropper is not inserted into the bottle. As illustrated, the collar 160 may extend below the flange 152 and may include a tapered portion 162. The tapered portion 162 may facilitate insertion of the dropper 100 in a bottle (e.g., bottle 210 illustrated in FIGS. 2A-2E).

In some implementations, a force may be applied to insert the dropper into the bottle (e.g., since the collar of the dropper may have approximately the same and/or a larger diameter than an opening of the bottle). The tapered portion 162 of the dropper may facilitate this insertion. When the dropper is inserted into a bottle (e.g., to close the bottle and/or to draw fluids), the gap 164 between the collar 160 and the pipette 130 may decrease (e.g., to allow the collar or a portion thereof to reside in the neck of the collar). The collar 160 may have a length such that at least a portion of the body of the collar may extend at least partially into the bottle 210 (e.g., neck 220), as illustrated. The outer surfaces of at least a portion of the wall(s) of the collar may contact an inner surface 214 of the bottle 210, such as the inner surface 214 of the neck 220 of the bottle. In some implementations, the described dropper may have at least 50% greater surface area contact with the bottle than a conventional dropper. Contact between the collar and the neck may inhibit fluids from leaking from the bottle via the bottle opening since the dropper may substantially and/or completely close the bottle opening. Thus, the dropper may be utilized as a cap without an additional closure mechanism, such as a skirt, clamp, etc.

In some implementations, use of a dropper as a cap may increase user satisfaction with the dropper and/or the bottle containing fluids among people with limited grip capabilities (e.g., some disabled, elderly, and/or arthritic users) when compared with conventional droppers (e.g., a dropper attached to a skirt that screws onto a top of a bottle). For example, the dropper can be inserted and removed from a bottle without twisting the dropper and/or with less twisting of the dropper, thus may be easier among people with limited grip capabilities.

In some implementations, dropper lifetime may be increased using a described dropper rather than a conventional dropper (e.g., a dropper attached to a skirt that screws onto a top of a bottle). As a dropper is grasped and twisted, the bulb of the dropper may tear (e.g., microscopically). These tears in the bulb may decrease the life (e.g., since the bulb may eventually shear from the dropper) and may increase leaks (e.g., through the tears). Thus, by allowing the dropper to be removed without twisting the bulb, the lifetime of the dropper may be increase.

In various implementations, the closure provided by the dropper (e.g., for a bottle opening) may inhibit leaking of fluids from a bottle. The collar of the dropper may retain the dropper in the bottle (e.g., as illustrated in FIGS. 2A-2E), for example, until a force from a user to remove the dropper is applied to the dropper. The length of the collar (e.g., extension into the neck of the bottle) and/or the contact of the outer surfaces of the collar and the inner surfaces of the bottle may inhibit accidental removal of the dropper from the bottle and/or leaks. For example, fluid in the bottle may not be inhibited from passing between an outer surface of the collar and the inner surface of the bottle (e.g., a gap may not reside between an outer surface of the collar and the inner surface of the bottle). In various implementations, the length of the collar and/or contact of the collar with the inner surface of the bottle (e.g., neck of the bottle) may inhibit loosening of the dropper from the collar due to vibration (e.g., during shipping, delivery, and/or commercial or personal transport), changes in temperature (e.g., during shipping, delivery, air travel, etc.), changes in pressure (e.g., during shipping, delivery, air travel, etc.). The flange may have a dimension (e.g., diameter, length and/or width) greater than a dimension (e.g., diameter, length and/or width) of the bottle opening. Thus, the flange of the dropper may at least partially block fluids from leaking though the opening of the bottle. In some implementations, the dimensions of the collar (e.g., length and/or contact with a bottle inner surface) and/or flange may inhibit inadvertent loosening of the dropper as a cap to a bottle due to manufacturing imperfections in the dropper and/or bottle and/or due to closure imperfections. Since the collar is in contact with the inner surface of the bottle over the elongated body of the collar, even if a portion of the collar is removed, the remaining portion disposed within the bottle may inhibit leaking.

FIGS. 1A-1E illustrate an implementation of an example dropper. However, a dropper may or may not include one or more of the described features. Various features may be added, deleted, and/or modified. For example, the first cavity of the bulb may be approximately uniform in size. As another example, the wall of the bulb proximate the first cavity may be narrower in thickness than one or more other portions of the bulb. The narrower wall 129 may facilitate squeezing and/or depressing the bulb during use.

A bulb may have any appropriate shape. For example, a bulb may not include a flared portion. A bulb may narrow proximate a second end of the bulb. A bulb may have approximately the same cross-sectional shape and/or area along a length of the bulb.

In some implementations, use of the collar to secure and/or retain the dropper in a bottle may decrease damage due to overtightening. By allowing the dropper to be pushed into a bottle rather than torqued, tears due to twisting the bulb may be reduced.

Although the flange of a bulb is illustrated as ring shaped, the flange may have other shapes and/or may not continuously circumscribe an outer surface of the bulb. The flange may include one or more protrusions extending away from the body of the bulb.

In some implementations, the collar of the bulb may include one or more gripping features. For example, the collar may include protrusions and/or textures facilitated to increase contact and/or friction between the dropper and an inner surface of the bottle. In some implementations, the collar may include rings disposed about the collar to contact and/or retain the dropper in the bottle. The ring(s) may be disposed proximate a second end of the bulb.

A pipette may or may not have the same cross-sectional area along the length of the pipette. The lumen may or may not have the same cross-sectional area long the length of the pipette.

As another example, the pipette flange may include one or more protrusions extending radially proximate the first end (e.g., as opposed to a continuous flange about the first end as illustrated in FIG. 1E). As another example the pipette may include a recess and a cavity of the bulb may include a protrusion received by the recess of the pipette to retain the pipette in the bulb.

In some implementations, the first end of the pipette may not include a pipette flange. The first end of the pipette may be retained in the bulb via a frictional fit between a cavity of the bulb and an outer surface of a portion of the pipette. In some implementations, the first end of the pipette may be retained by a narrowing of a cavity of the bulb about the pipette. The first end of the pipette may be retained in the bulb by an adhesive or other bonding agent applied between a portion of the pipette and a portion of a cavity of the bulb.

In some implementations, the dropper may be utilized with a skirt as a cap for a bottle. The skirt may further secure a dropper to the bottle, inhibit damage to the neck of a bottle, and/or inhibit the dropper from being inadvertently knocked out (e.g., when the bottle is dropped or knocked out of hand). FIGS. 3A-3E illustrate an implementation of an example dropper with a skirt 300, from various perspectives. FIGS. 4A-4E illustrate an implementation of an example bottle assembly 400 that illustrates a dropper 100 with a skirt 310 in a bottle 210, from various perspectives. As illustrated, the dropper 100 may include a bulb 110 and a pipette 130 disposed in the bulb. The bulb may include a first cavity 116, a second cavity 118, and/or a narrow portion 117 disposed between the first cavity and the second cavity. An exterior surface of the bulb may include a tapered portion 150, a flange 152, and a recess 154 between the tapered portion and the flange.

A skirt 310 may have an inner surface 312 and an outer surface 314. A portion of the inner surface may be configured to contact a bottle. A portion of the outer surface may or may not include a texture (e.g., ribbed) to facilitate gripping of the skirt from the outer surface. The skirt may have an opening through the top 316 of the skirt and wall(s) may extend from the top of the skirt. The recess 154 of the bulb may be designed to receive at least a portion of the top 316 of the skirt 310. As illustrated, the top 316 of the skirt may include an opening extending through the top. The dropper 100 may be disposed through this opening in the skirt 310. An edge of the opening (e.g., a portion of the top of the skirt) may be received by and/or may be disposed proximate the recess 154 of the bulb. Thus, the skirt may reside between the tapered portion 150 and the flange of the bulb 110. In some implementations, at least a portion of the inner surface of the top of the skirt may rest on (e.g., contact) the flange. The skirt may or may not be capable of rotating about the bulb while disposed in the recess of the bulb. The tapered portion of the bulb may flare outwards (e.g., away from a cavity of the bulb) such that the opening may be covered and/or partially covered by the flared portion. Thus, the flared portion may further inhibit leakage of fluids in the bottle via the opening in the skirt. An inner surface of the wall(s) 318 of the skirt 310 may include threading 320. The threads 320 of the skirt may be capable of coupling with threads 222 of the bottle 210.

As illustrated in FIGS. 4A-4E, a bottle assembly 400 may include a dropper 100 with a skirt 310 that may be a cap for the bottle 210. The dropper may be inserted into the bottle. The dropper may be pushed to insert the collar 150 of the bulb 110 into the cavity of the bottle 210. The dropper may be pushed into the bottle until the flange 152 contacts the lip 224 of the neck 220 of the bottle. In some implementations, the dropper 100 may be partially inserted into the bottle and then the skirt may be rotated to engage the threads 320 of the skirt with the threads 222 of the bottle. The dropper may thus be further inserted into the bottle by the rotation of the skirt until the flange is disposed proximate the lip 224 of the bottle 210. The bottle may be closed and leaking may be inhibited when the flange is disposed proximate the lip of the bottle and the collar is disposed in the bottle (e.g., the neck of the bottle and/or the cavity of the bottle).

In various implementations, the tapered portion of the collar may be approximately conical in shape. A wider portion of the tapered portion of the collar may be slightly larger than a bottle opening. This may cause the dropper to act in a similar manner as a corking to improve sealing and griping of the bottle by the dropper, in some implementations. The dropper may protect against vibrations, temperature changes, atmospheric pressure, bottle imperfections and/or a loose cap, in some implementations. The dropper may, in some implementations, eliminate leaking associated with shipping and transportation (e.g., via rail, air, truck, and/or car).

In some implementations, a bulb of the dropper may not include a tapered portion and/or recess (e.g., recess 154) between the tapered portion of the bulb and the flange. The dropper may be inserted into a bottle and the collar may contact the inner sides of the bottle to inhibit leaks from the bottle. In some implementations, the dropper may include a skirt. The skirt may be capable of sliding up, down, on and/or off the first end of the bulb (e.g., since the bulb may not include tapered portion and/or recess proximate the tapered portion to receive a portion of the skirt). Thus, the bulb may be coupled to a bottle with the skirt disposed on the dropper and/or the bulb may be coupled to the bottle and then the skirt may be coupled to the bottle. For example, a user may insert the dropper at least partially into a cavity of the bottle such that the collar of the dropper contacts the inner surface of the bottle to inhibit leaks. The opening of the skirt may then receive the bulb (e.g., already coupled to the bottle) and be positioned on the bottle. The skirt may then couple with an outer surface of the bottle (e.g., via threads). Coupling the skirt may or may not further insert the dropper into the cavity of the bottle. As another example, a user may insert the dropper at least partially into a cavity of the bottle, which may dispose a skirt on a portion of the bottle, such as the neck. The collar of the dropper may be inserted such that the collar contacts the inner surface of the bottle to inhibit leaks and the skirt may be, for example, rotated to couple to the bottle. In some implementations, a user may insert the dropper at least partially into a cavity of the bottle, which may dispose a skirt on a portion of the bottle, such as the neck. The skirt may then be, for example, rotated to further insert the dropper in the bottle and insert the collar of the dropper such that the collar contacts the inner surface of the bottle to inhibit leaks.

In various implementations, a dropper may include a bulb, with a closed end and an opposing open end. The bulb may be capable of receiving a pipette. The bulb may include at least one cavity extending between the closed and the open end of the bulb.

The cavity may include a pipette coupling member (e.g., recess, ledge between cavities and/or portions of cavities, etc.) configured to receive at least a portion of a pipette. The pipette coupling member may retain at least a portion of the pipette in the cavity of the bulb during use. For example, when a dropper is being inserted into a bottle to close the bottle and/or pulled from a bottle to open the bottle, the pipette coupling member may retain the pipette at least partially in the cavity of the bulb so that the bulb and the pipette are moved together. The pipette coupling member may include a recess in the cavity of the dropper that is capable of receiving a portion of the pipette such as a lip of the pipette (e.g., proximate a top of the pipette). As another example, the pipette coupling member may include a protrusion that extends from a wall of a cavity in the bulb. The protrusion may form a ledge that retains the pipette in the bulb. A lip of the pipette may be inserted into the cavity of the bulb and rest on the ledge. The ledge may inhibit the pipette from being accidentally removed during use. In some implementations, the pipette coupling member may be a narrowing of the cavity that retains the pipette in the cavity of the bulb.

The bulb may include a flange and a collar. The flange of the bulb may extend from an outer surface of the body of the bulb between the open end and the closed end of the body. The flange may or may have a shape similar to a cross-sectional shape of a top surface of a neck of a bottle and/or an aperture in the opening of a neck. For example, the flange may be circular, oval, etc. The flange of the bulb may include a first surface (e.g., proximate the closed end of the bulb) and an opposing second surface (proximate the open end of the bulb). The flange of the bulb may have a greater diameter than an opening of a bottle in which the dropper is positionable, in some implementations. By allowing the flange to be larger than the opening of a bottle, leaks may be inhibited. For example, fluids in the bottle that splash upward (e.g., from motion of the bottle such as motion during transport and/or the bottle falling) the flange may inhibit any fluid that leaks past the collar from exiting the bottle (e.g., by physically blocking such leakage).

The collar of the bulb may be disposed proximate the open end of the bulb. The collar may have a size similar and/or larger than the inner side walls of an opening of the bottle (e.g., in the neck of the bottle). The collar may include an inner surface proximate the cavity of the bulb and an outer surface. The outer surface of the collar may contact at least a portion of the inner walls of the bottle. In some implementations, the collar dimensions may be larger than the inner dimensions of the opening of the bottle such that a force may be applied to the dropper and/or collar to insert the collar in the bottle. The force may compress the collar such that a seal is formed with the bottle to inhibit leaks. In some implementations, an outer surface of the collar may include one or more recesses. If excess fluid (e.g., from inside the bottle) is disposed proximate the collar (e.g., upon insertion of the dropper in the bottle) the fluid may accumulate in the recess(es) of the outer surface of the collar. Allowing the fluid to accumulation in the recess(es) rather than proximate other portions of the outer surface of the collar may increase the contact between the collar and the inner surfaces of the bottle and inhibit leaks. The inner surface may contact part of the pipette.

The pipette of the dropper may be disposed at least partially in the open end of the bulb. The pipette of the dropper may extend into the cavity of the bulb (e.g., extend into and be proximate the inner surface of the collar, extend past the collar, etc.). The pipette of the dropper may extend into the cavity of the bulb (e.g., extend into and be proximate the inner surface of the collar, extend past the collar, etc.). The pipette may include a top portion, which is received in the pipette receiving member of the cavity of the bulb, and an elongated body. The elongated body may include a lumen (e.g., disposed through the elongated body of the pipette).

In various implementations, a gap may reside between at least a portion of the inner surface of the collar of the bulb and at least a portion of an outer wall of the pipette disposed in the collar. The gap may allow radial movement of at least a portion of the pipette disposed in the collar. Since the pipette coupling member retains the pipette in the bulb, the radial movement may be allowed without concern of the pipette releasing from the bulb (e.g., falling out). As a dropper is inserted in a bottle, the walls of the collar may at least partially compress however, at least a portion of the gap may remain. The compression of the collar may create a seal between the dropper and the bottle and inhibit leaks. The gap may inhibit crushing of the pipette due to the force of inserting the dropper in a bottle. For example, in conventional droppers, the pipette is held in place by the inner walls of the dropper and thus force exerted by pushing a dropper into a bottle would be transferred, at least in part, to the pipette, which may cause breakage and decrease user satisfaction (e.g., since the dropper may be broken, the fluid in the bottle may be discarded since pieces of the pipette may be in it, etc.).

In some implementations, an implementation of the dropper may include the dropper described in U.S. Design patent application Ser. No. 29/664,291, filed Sep. 24, 2018, which is hereby incorporated by reference to the extent that it does not conflict with the described systems and processes.

In various implementations, the dropper, when used as a cap (e.g., with and/or without the skirt) may satisfy industry and/or government regulations regarding allowable leakage. For example, the dropper may allow leakage less than 8% when the dropper is used as a cap. As another example, the dropper may allow leakage of less than 1%

The flexible material of the bulb may include any appropriate flexible material. The flexible material may include natural and/or synthetic rubber(s). The flexible material may include TPE (thermoplastic elastomer).

Figure 3A:
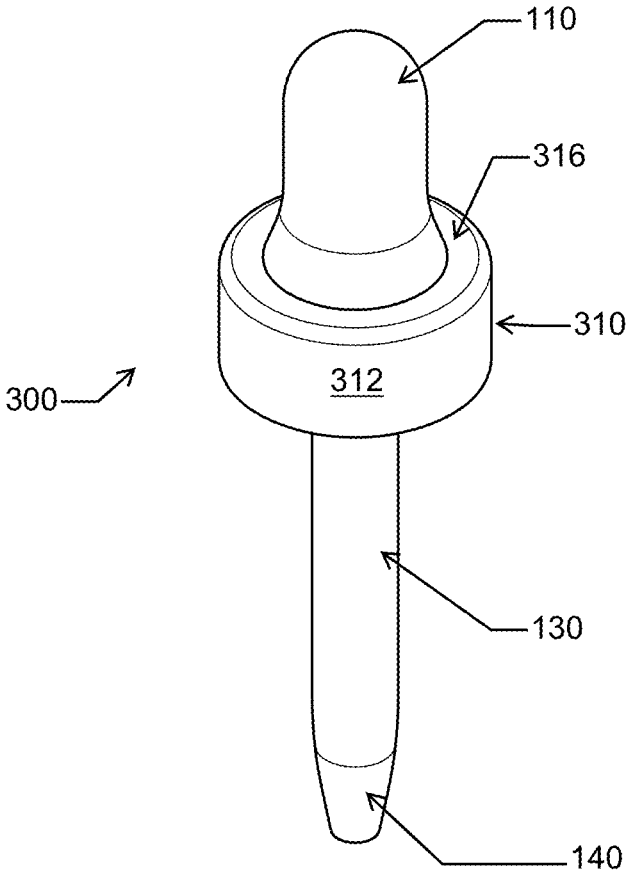
FIG. 3A illustrates a top perspective view of an implementation of an example dropper with an example skirt.
Figure 3B:
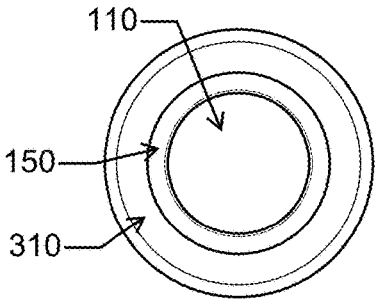
FIG. 3B illustrates a top view of an implementation of the example dropper and the example skirt illustrated in FIG. 3A.
Figure 3C:
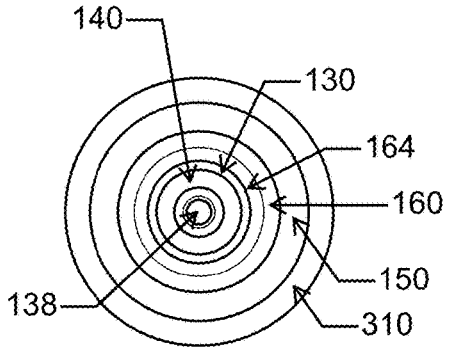
FIG. 3C illustrates a bottom view of an implementation of the example dropper and the example skirt illustrated in FIG. 3A.
Figure 3D:
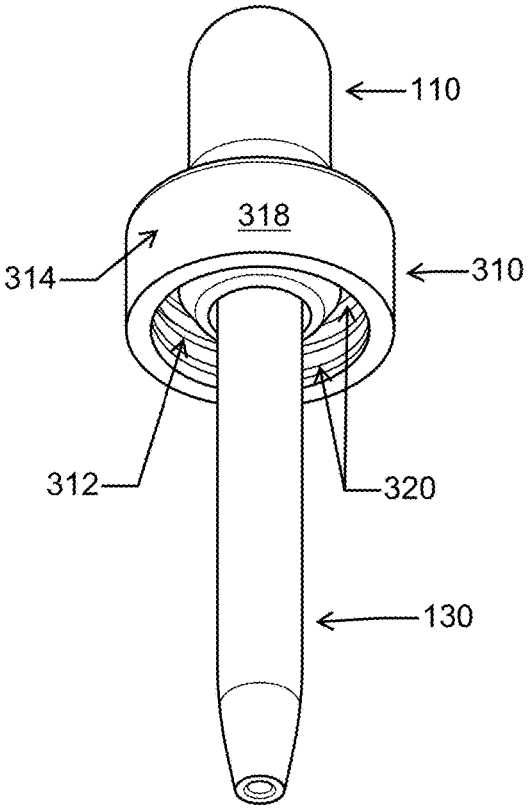
FIG. 3D illustrates a bottom perspective view of an implementation of the example dropper and the example skirt illustrated in FIG. 3A.
Figure 3E:
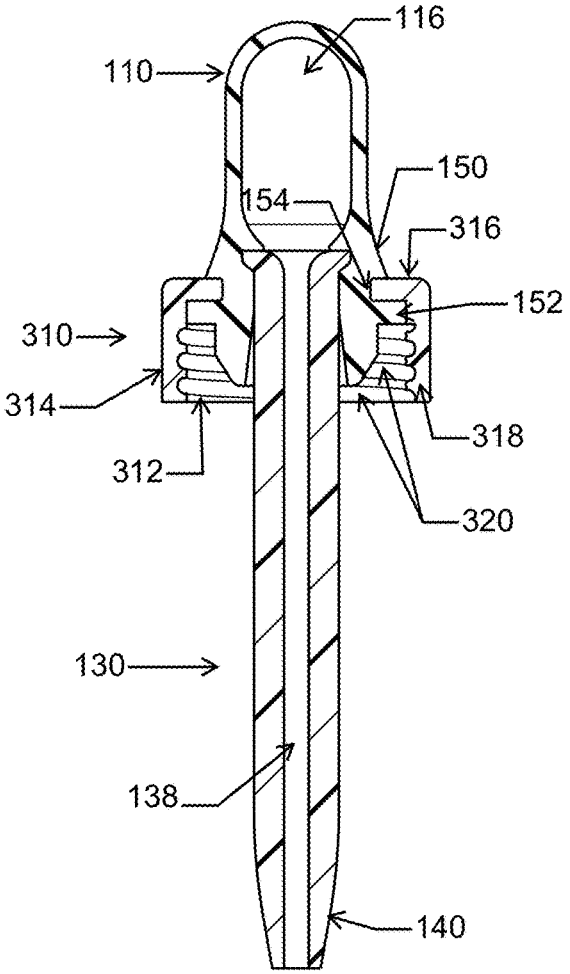
FIG. 3E illustrates a cross-sectional view of an implementation of the example dropper and the example skirt illustrated in FIG. 3A.
Figure 4A:
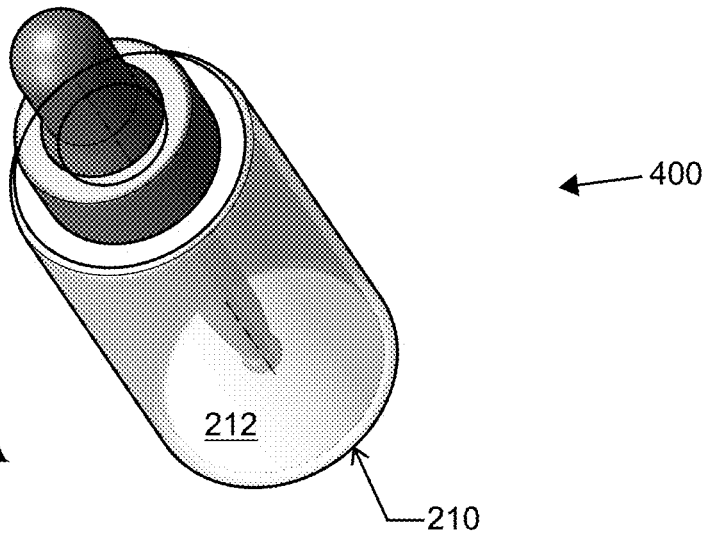
FIG. 4A illustrates a top perspective view of an implementation of an example dropper with an example skirt disposed in a bottle.
Figure 4B:
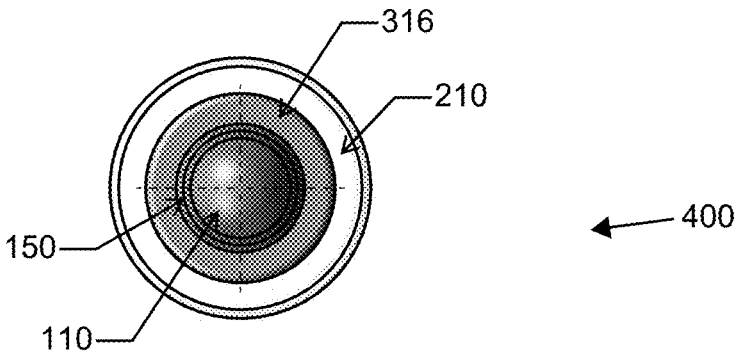
FIG. 4B illustrates a top view of an implementation of the example dropper and the example skirt illustrated in FIG. 4A.
Figure 4C:
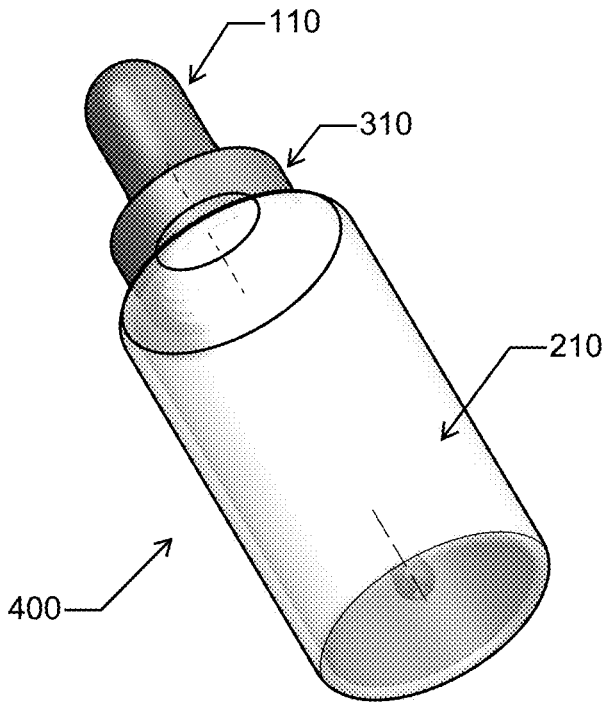
FIG. 4C illustrates a bottom perspective view of an implementation of the example dropper and the example skirt illustrated in FIG. 4A.
Figure 4D:
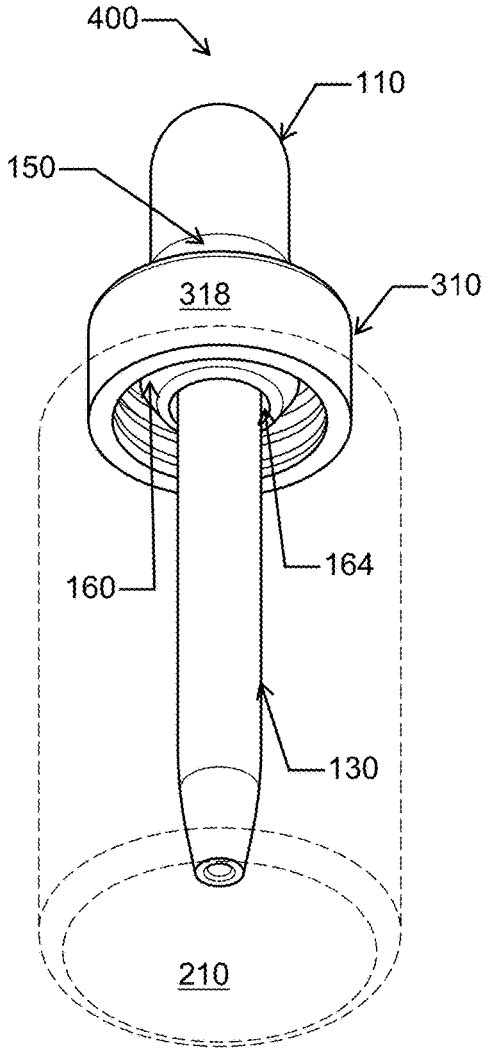
FIG. 4D illustrates a cutaway bottom perspective view of an implementation of the example dropper and the example skirt illustrated in FIG. 4A.
Figure 4E:
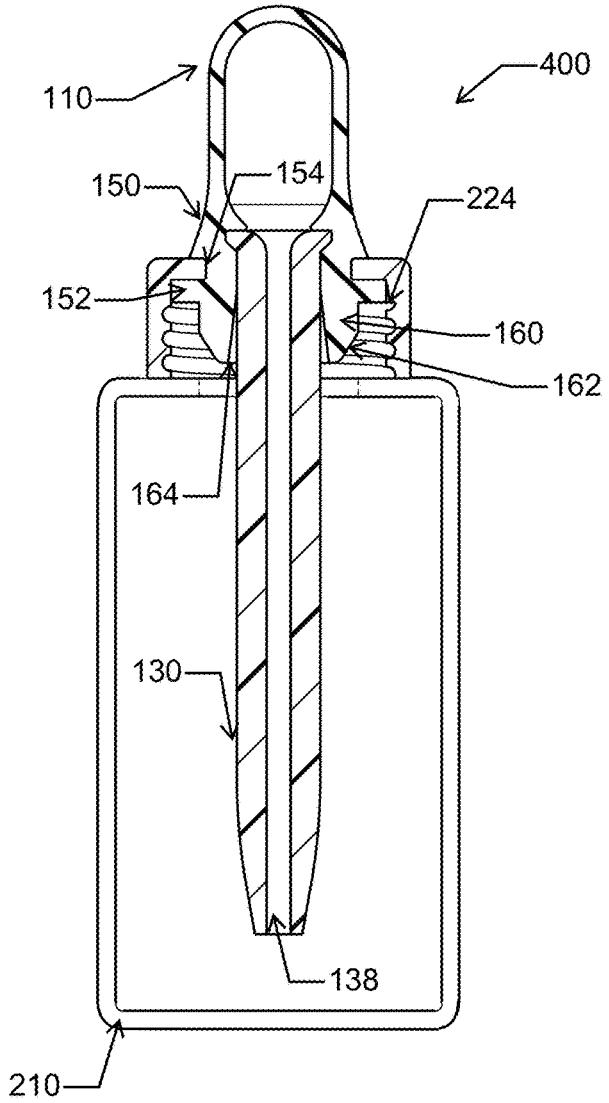
FIG. 4E illustrates a cross-sectional view of an implementation of the example dropper and the example skirt illustrated in FIG. 4A.

Although the pipette of the dropper has been described as cylindrical and/or linear, the pipette may have other shapes. The pipette may have a curved and/or bent tip. For example, the tip of the pipette may be disposed at an angle (e.g., greater than 0 degrees, greater than 20 degrees) such that the tip is slanted relative to the body. The pipette may have any appropriate tip, such as but not limited to a tapered end (e.g., as illustrated in FIG. 3A), a blunt end, a rounded end (e.g., as illustrated in FIG. 1A), any other appropriate shape for a pipette end, and/or combinations thereof.

The pipette may be formed of any appropriate material, such as glass, borosilicate glass, plastic, etc. The pipettes may be any appropriate type of pipette such as graduated and/or volumetric. The pipettes may be for any appropriate volume. For example, the pipette may or may not be a micropipette. As another nonlimiting example, the pipette may or may not be a macropipette.

In various implementations, a skirt of a bottle cap has been described as threaded. However, the bottle cap may be child resistant. For example, a user may need to exert a force downwards (e.g., towards a bottom of a bottle) and twist the skirt to release the child resistant bottle cap from the bottle. In some implementations, the bottle cap may be tamper evident. For example, the skirt may include a perforation and a portion that separates from the skirt when the skirt is removed from the bottle (e.g., the bottle opened).

In various implementations, the dropper may be used with any appropriate type of bottle (e.g., glass, plastic, graduated, single dose, cylindrical, spherical, rectangular cross-sectioned, irregularly shaped, etc.). The bottle may have any appropriate color and/or any appropriate coating.

In various implementations, the dropper may be replaceable and a first dropper may be removed and a second dropper may be utilized in place of the first dropper with a bottle. The pipette and/or bulb of the dropper may be replaceable, in some implementations. For example, when a bulb wears (e.g., tears, rips, etc.), the bulb may be removed and the existing pipette may be inserted at least partially into a new bulb. As another example, if a pipette breaks, the pipette may be removed and replace with a new pipette.

Although users have been described as a human, a user may be a person, a group of people, a person or persons interacting with one or more computers, and/or a computer system. (e.g., robotics)

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a flange" includes a combination of two or more flanges and reference to "a flexible material" includes different types and/or combinations of flexible materials. As another example, a cavity may include more than one cavity.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A dropper system comprising:

a bulb, wherein the bulb comprises:

a closed end;

an open end opposing the closed end; and a cavity extending between the closed end and the open end of the bulb, and wherein a pipette coupling member retains at least a portion of a pipette in the cavity of the bulb, and wherein the cavity comprises a narrow portion proximate a top portion of the pipette, and wherein the narrow portion of the cavity approximately aligns with a lumen of the pipette such that fluid in the bulb of the dropper system is transmitted to the lumen of the pipette when the bulb is depressed;

a flange extending from an outer surface of a body of the bulb between the open end and the closed end of the bulb, wherein the flange comprises a first surface and a second surface opposing the first surface, and wherein the flange has a diameter greater than an opening of a bottle in which a dropper is positionable;

a collar disposed proximate the open end of the bulb, wherein the collar comprises an inner surface proximate the cavity of the bulb and an outer surface, and wherein the collar comprises an opening that provides access to the cavity of the bulb, wherein the opening has a diameter greater than a diameter of the pipette to be received in the cavity, wherein the inner surface of the collar is tapered between the opening and the flange such that a frustoconical annular gap is created between an outer wall of the pipette and an inner wall of the collar, wherein the gap decreases when the dropper is inserted into the bottle.

2. The dropper system of claim 1 further comprising the pipette positionable at least partially in the cavity of the bulb, wherein the pipette and the bulb may be removably coupled, and wherein the pipette and the bulb may be uncoupled.

3. The dropper system of claim 1 further comprising:

the bottle, wherein the bottle comprises:

a neck comprising:

the bottle opening disposed through the neck into a bottle cavity; and a top surface proximate the bottle opening;

wherein the second surface of the flange of the bulb is configured to contact the top surface of the neck of the bottle when the dropper closes the bottle;

wherein the collar of the bulb is disposed in the bottle when the dropper closes the bottle;

wherein inner walls of the neck contact at least a portion of the outer surface of the collar of the bulb, when the dropper is disposed in the bottle to retain the dropper in the bottle and inhibit leaks from the bottle.

4. The dropper system of claim 1 wherein the collar comprises a tapered portion, and wherein the tapered portion eases insertion of the dropper into the bottle.

5. The dropper system of claim 1 wherein the collar includes one or more gripping features.

6. The dropper system of claim 1 wherein the flange comprises one or more protrusions extending from the bulb.

7. The dropper system of claim 1 wherein the collar is at least partially compressed when the collar of the bulb is inserted into the bottle to close the bottle such that leaks are inhibited.

8. The dropper system of claim 1 further comprising:

the pipette comprising:

the top portion, wherein the top portion is received in the pipette receiving member of the cavity of the bulb;

and an elongated body with the lumen disposed through the elongated body of the pipette;

wherein the pipette is disposed partially in the cavity of the bulb.

9. The dropper system of claim 8, wherein the pipette comprises at least one of a curved end portion, or a bent end portion, such that a tip of the pipette is disposed at an angle relative to the elongated body.

10. A dropper system comprising:

a bulb, wherein the bulb comprises:

a closed end;

an open end opposing the closed end; and a cavity extending between the closed end and the open end of the bulb;

a flange extending from an outer surface of a body of the bulb between the open end and the closed end of the bulb, wherein the flange comprises a first surface and a second surface opposing the first surface, and wherein the flange has a diameter greater than an opening of a bottle in which a dropper is positionable, and wherein the flange of the bulb has a greater diameter than a flared portion of the bulb;

a recess disposed on an outer surface of the bulb between the closed end of the bulb and the flange;

a collar disposed proximate the open end of the bulb, wherein the collar comprises an inner surface proximate the cavity of the bulb and an outer surface, and wherein the collar comprises an opening that provides access to the cavity of the bulb, wherein the opening has a diameter greater than a diameter of a pipette to be received in the cavity, wherein the inner surface of the collar is tapered between the opening and the flange such that a frustoconical annular gap is created between an outer wall of the pipette and an inner wall of the collar, wherein the gap decreases when the dropper is inserted into the bottle.

11. The dropper system of claim 10 further comprising the pipette partially disposed in the cavity of the bulb.

12. The dropper system of claim 10 wherein the collar is at least partially compressed when the collar of the bulb is inserted into the bottle to close the bottle such that leaks are inhibited.

13. The dropper system of claim 10 wherein the dropper further comprises:

a cap, wherein the cap comprises:

a skirt, wherein the skirt comprises an aperture through which the bulb may be disposed, and wherein the skirt is received by the recess of the bulb;

and side walls extending from the skirt, wherein the side walls may be disposed proximate outer side walls of a neck of the bottle when the dropper is disposed in the bottle.

14. The dropper system of claim 13 wherein the side walls of the cap comprise threads configured to mate with threads on an exterior of the bottle.

15. The dropper system of claim 13 wherein at least a portion of the skirt is perforated and a portion of the skirt separates when the skirt is removed from the bottle.

16. The dropper system of claim 13 wherein the side walls of the cap comprise threads configured to mate with threads on an exterior of the bottle and wherein to remove the cap from the bottle a downward force must be exerted on the cap while twisting the cap.

17. A dropper comprising:

a bulb, wherein the bulb comprises:

a closed end;

an open end opposing the closed end; and a cavity extending between the closed end and the open end of the bulb;

a flange extending from an outer surface of a body of the bulb between the open end and the closed end of the bulb, wherein the flange comprises a first surface and an opposing second surface, and wherein the flange has a greater diameter than an opening of a bottle in which the dropper is positionable;

a collar disposed proximate the open end of the bulb, wherein the collar comprises an inner surface proximate the cavity of the bulb and an outer surface, wherein the collar comprises an opening that provides access to the cavity of the bulb, and wherein the inner surface of the collar is tapered between the opening and the flange;

a pipette comprising:

a top portion, wherein the top portion is received in the cavity of the bulb;

an elongated body with a lumen disposed through the elongated body of the pipette; and a frustoconical annular gap residing between at least a portion of the inner surface of the collar and at least a portion of an outer wall of the pipette disposed in the collar such that at least a part of the portion of the pipette disposed in the collar can radially move, wherein the gap decreases when the dropper is inserted into the bottle.

18. The dropper of claim 17 wherein the collar is at least partially compressed when the collar of the dropper is inserted into the bottle to close the bottle such that leaks are inhibited.

19. The dropper of claim 17 wherein the cavity of the bulb comprises a narrow portion proximate the top portion of the pipette, and wherein the narrow portion of the cavity approximately aligns with the lumen of the pipette such that fluid in the bulb of the dropper is transmitted to the lumen of the pipette when the bulb is depressed.

20. The dropper of claim 17 further comprising:

a cap, wherein the cap comprises:

a skirt, wherein the skirt comprises an aperture through which the bulb is disposed, and wherein a flared portion of the bulb extends over the skirt and has a diameter greater than the aperture of the skirt;

and side walls extending from the skirt, wherein the side walls may be disposed proximate outer side walls of a neck of the bottle when the dropper is disposed in the bottle.

* * * * *